US006447393B1

(12) United States Patent
McCabe

(10) Patent No.: US 6,447,393 B1
(45) Date of Patent: Sep. 10, 2002

(54) ELECTRIC POWER MODULATED LEAD SCREW ACTUATED BUTTERFLY BLADE DAMPER AND METHOD OF CONTROLLING AIR FLOW AND PRESSURE AND PNEUMATIC TWO POSITION OPERATOR

(76) Inventor: Francis J. McCabe, #6 Bunker Hill Rd., Ottville, PA (US) 18942

( * ) Notice: Subject to any disclaimer, the term of this patent is extended or adjusted under 35 U.S.C. 154(b) by 0 days.

(21) Appl. No.: 09/733,380

(22) Filed: Apr. 29, 2000

Related U.S. Application Data

(63) Continuation-in-part of application No. 09/379,032, filed on Aug. 23, 1999, now Pat. No. 6,224,481.

(51) Int. Cl.[7] ..... A62C 2/12
(52) U.S. Cl. ..... 454/369; 454/342
(58) Field of Search ..... 454/369, 342, 454/357, 256, 257, 259; 126/287.5; 137/72

(56) References Cited

U.S. PATENT DOCUMENTS 3,697,142 A * 10/1972 Fortier ..... 308/5
4,273,283 A * 6/1981 Edwards ..... 236/49
5,456,633 A * 10/1995 Choi ..... 454/256
5,462,485 A * 10/1995 Kinkead ..... 454/256
5,590,830 A * 1/1997 Kettler et al. ..... 236/49.3
5,971,067 A * 10/1999 Rayburn et al. ..... 165/217

* cited by examiner

*Primary Examiner*—Harold Joyce
*Assistant Examiner*—Derek S. Boles
(74) *Attorney, Agent, or Firm*—Frank J. Bensautti

(57) ABSTRACT

A damper assembly in which the position of the damper blades is controlled by a powered actuator which can be powered by a pneumatic drive, an electric motor drive, or other suitable power source. The powered actuator moves a drive shaft attached to the damper blades which causes the damper blades to open and close or be positioned somewhere in-between. The actuator can be controlled by sensors in a remote location. The actuator allows the damper to be modulated to set up pressure differentials and to be closed well in advance of oncoming smoke, fire, or other detected toxic fumes.

10 Claims, 11 Drawing Sheets

ELECTRIC POWER MODULATED LEAD SCREW ACTUATED BUTTERFLY BLADE DAMPER AND METHOD OF CONTROLLING AIR FLOW AND PRESSURE AND PNEUMATIC TWO POSITION OPERATOR

CROSS-REFERENCE TO RELATED APPLICATION

This application is a continuation-in-part of my prior application, Ser. No. 09/379,032, filed Aug. 23, 1999 entitled POWER MODULATING LEAD SCREW ACTUATED BUTTERFLY BLADE ACTION DAMPER now U.S. Pat. No. 6,224,481 issued May 1, 2001; which application is incorporated herein as if fully set forth.

BACKGROUND OF THE INVENTION

1. Technical Field

This invention relates to air/smoke/fire dampers. In particular, it relates to dampers which can be controlled to be set and reset (i.e., closed and opened) locally or remotely under power, and which seal the damper under pressure when the damper blades are in the closed position, and which can be operated partially closed to modulate pressure levels and to prevent smoke migration. This invention is also capable of setting normal operating building pressure differentials for cleaner air environments.

2. Background Art

Non-butterfly type dampers which can be closed automatically upon actuation by a heat-sensitive or other device are well-known in the art. Some such non-butterfly type dampers snap closed under either their own weight (i.e., gravity), or by mechanical force provided by springs. See, for example, U.S. Pat. Nos. 4,301,569 and 4,442,862.

As the art developed, external controls were devised to activate these dampers. Further, controls were also developed to cause the damper to be reset, that is, to be reopened to a ready position for heat responsive actuation in the event of fire or smoke conditions. A disadvantage of these prior art dampers is that they typically have virtually unsealable multiple vanes that are activated by a separate device exposed to the heat from a fire. As a result, the heat may disable the drive linkage, thus interfering with reactivation. Also, a substantial amount of smoke and even flames may pass through the damper before it is activated (if at all). It would be advantageous to have a simple two blade butterfly type damper system that could be activated more reliably in advance of the fire or smoke passing through the system, to more effectively prevent either from passing through the damper.

In addition to problems caused by complicated heat responsive closure, dampers which are closed by gravity or spring driven devices do not always form an effective seal. As a result, even though the damper may be in the closed position, smoke and flames may pass through the damper and spread to other parts of the building. It would be desirable to have dampers that form an effective seal rather than merely temporarily contain either the fire or the progress of smoke.

Typical multi-blade dampers can be actuated to control flow by a pneumatic actuator. However, it is desirable to have an override for the pneumatic control which will close the damper in case of a fire.

Also in the multi-blade damper, if the blades are pivoted in their longitudinal center, the air and heat does not help to keep the seal shut. Rather, pressure on one side of the pivot of the blade tends to force it open, while pressure on the other tends to force it closed. It is, therefore, desirable to have a simple end pivoted two blade damper which is forced even tighter closed and sealed under pressure.

It is further desirable to have a damper system in which the damper can be partially closed or opened, in order to modulate the pressure in the system. For example, it may be desirable to have more pressure in one room than another and to be able to adjust the opening in the damper, remotely, so as to affect the amount of air passing therethrough.

The prior art has failed to provide a damper which can be powered closed well before advancing smoke and fire arrives and have failsafe spring closure on power failure, which creates an effective seal, which can be sealed rapidly by a powered drive mechanism, and which can be partially opened and closed to modulate the pressure in the system in which the damper is used and have a simple two blade end pivoting with direct drive linkage for round and rectangular dampers.

SUMMARY OF THE INVENTION

My invention comprises a butterfly configured damper assembly in which operation of the damper blades is controlled by a powered actuator. The powered actuator can be powered by a pneumatic drive, a electric user controlled drive, or other suitable power source. In one embodiment, an electric powered actuator is attached to the damper blades via a rotating shaft. The actuator causes cycling of the damper blades to move them between an open and a closed position, and/or causes them to be set in intermediate positions to set up controlled pressure environments by modulating the air flow through the damper. In another preferred embodiment, a pneumatic motor powered actuator drives the shaft to cycle the damper blades between the open and the closed position. In another embodiment, the actuator can be self-controlled by a heat responsive device. A remote control system can communicate with the damper controls via a hard wired connection, or alternatively, via radio transmission. The powered actuation provides sufficient force to operate against heated air flow and to seal the damper tightly; which, in turn, prevents both the smoke and fire from easily passing through the damper. This design lends itself more readily to round or oval duct configurations. This configuration provides for a better seal in the case of the fully closed position of the blades.

DESCRIPTION OF THE PREFERRED EMBODIMENTS

Figure 1:
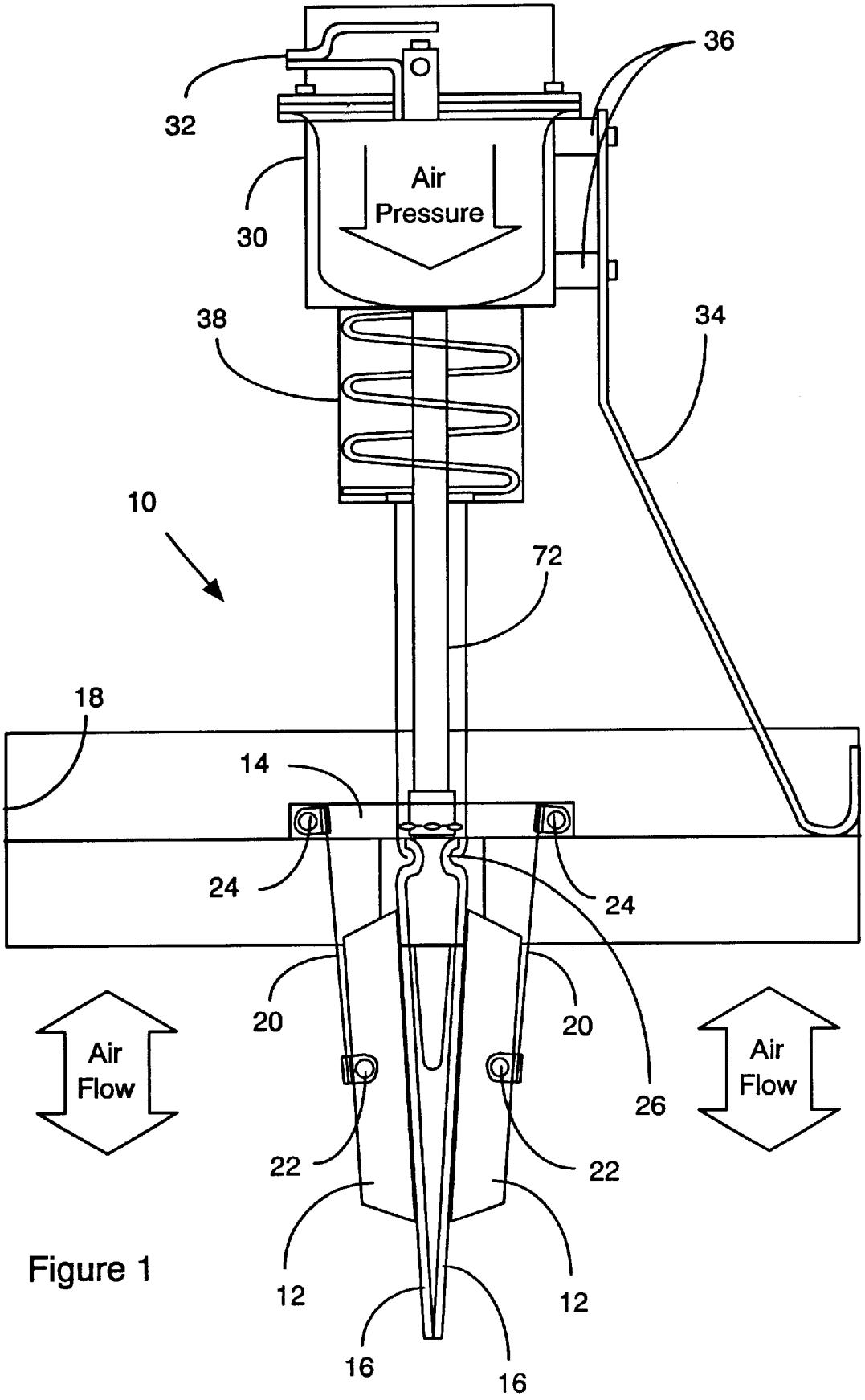
FIG. 1 is a side view partially broken away of a preferred embodiment of my invention that shows a damper assembly with a pneumatic actuator and with the blades in an open position.

FIG. 1 is a cutaway side view that shows a butterfly-type damper designated generally 10 of a type well known in the art. This damper is operated by a powered actuator 30. Such dampers 10 normally have two blades 16 which are shown in the open position. The blades 16 permit air to pass through damper 10 with minimal obstruction. Also shown in this view are blade stiffeners 12 which are attached to blades 16 and provide strengthening and rigidity to the structure of blades 16. Those skilled in the art will recognize that any suitable means can be used to secure the blade stiffeners 12 to the blades 16. For example, they can be welded, riveted, screwed, etc. In addition, any suitable material can be used to fabricate the blades 16 and the blade stiffeners 12. The only requirement is that the material selected will perform satisfactorily in fire or smoke conditions.

In this embodiment, the powered actuator 30 is a pneumatic actuator. Pneumatic drives are well known per se. Powered actuator 30 is secured to the damper 10 structure by a side brace 34 which is fixedly attached at one end to the frame 18 of the damper 10 and fixedly attached at the other end to mounting blocks 36 on the powered actuator 30. Between the powered actuator 30 and the damper 10, there is an actuator support bracket 38 to help maintain the relative position between the powered actuator 30 and the damper 10. Connected to the bracket 38 and the damper frame 18 is a mounting frame 39. The support bracket 38 and mounting frame 39 retain a shaft 72 which is axially connected to the shaft 54 of the actuator 30. Fixed mounted to both the actuator bracket 14 and the blade stiffeners 12 are members 20 which are connected at pivot points 22,24. When the shaft 54 is moved axially, the bracket 14 is moved axially, and the damper blades 16 are pivoted about pivot points 26. When the blades 16 pivot in this manner, they are moved from the open position shown in FIG. 1 to the closed position shown in FIG. 2.

The powered actuator 30 may be controlled by a heat responsive switch 32, such as a conventional bi-metallic device, which is well known in the art, or any other suitable switch. It may 210 also be controlled by remote sensors, by manual activation, or by a computerized alarm system. Those skilled in the art will recognize that when remote activation is used, the damper 10 may be closed well in advance of the arrival of the fire or smoke. This provides significant advantages in terms of damage control by reducing the possibility that smoke or fire may pass through the damper 10 before it is closed. Activation based on heat responsive devices may be preset to be activated over a wide range of temperatures.

Figure 2:
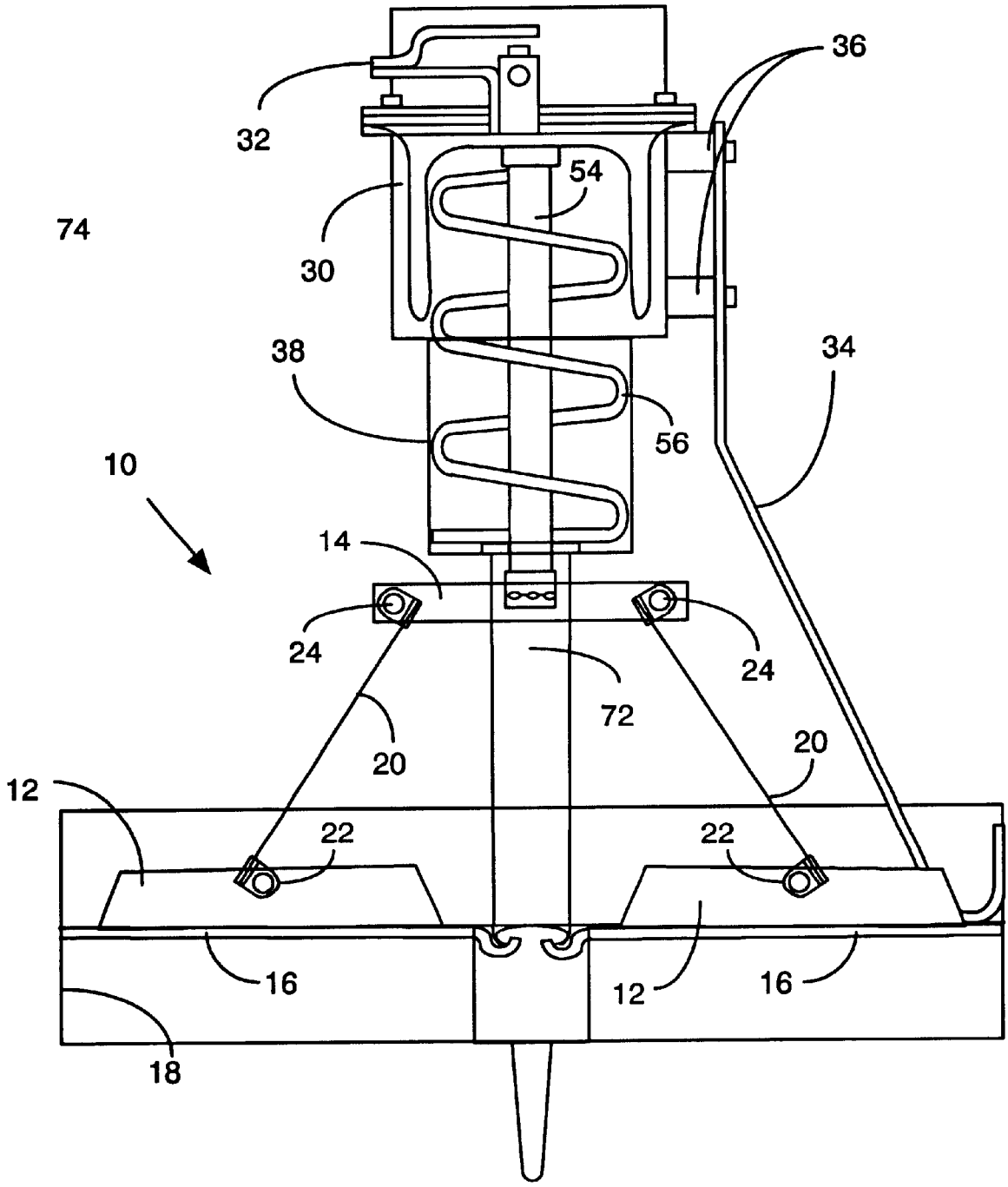
FIG. 2 is a cutaway side view of the preferred embodiment of FIG. 1 that shows the damper assembly with the blades in a closed position.

FIG. 2 is a cutaway side view that illustrates the preferred embodiment of FIG. 1 with the damper blades 16 in the closed position. In this embodiment, when the powered actuator 30 is triggered, a pneumatic bellows type valve 39 is opened and the damper 10 moves to the closed position under pressure provided by spring 56. The force supplied by the air flow forcibly presses the damper blades 16 against the damper frame 18 and holds the blades 16 in-place against any pressure build-up or differential pressure caused by fire, smoke, etc. Thus, a butterfly damper provides for not just a mechanical seal, but also an aerodynamic seal after the damper blades are closely mechanically.

The advantage of using the mechanical pressure of the spring 56 to seal the damper 10 in the first instance is that the mechanical pressure provided by the spring is less exposed to failure. Note that it is enclosed and down stream of the hot air flow.

The damper illustrated can be round or rectangular.

When heated, the bi-metal control 32 shown can push the plunger of the bellows-type valve and allow air to bleed off of that valve control. This allows the spring in the actuator to close the damper, because there is no air on the bladder of the actuator.

Figure 3:
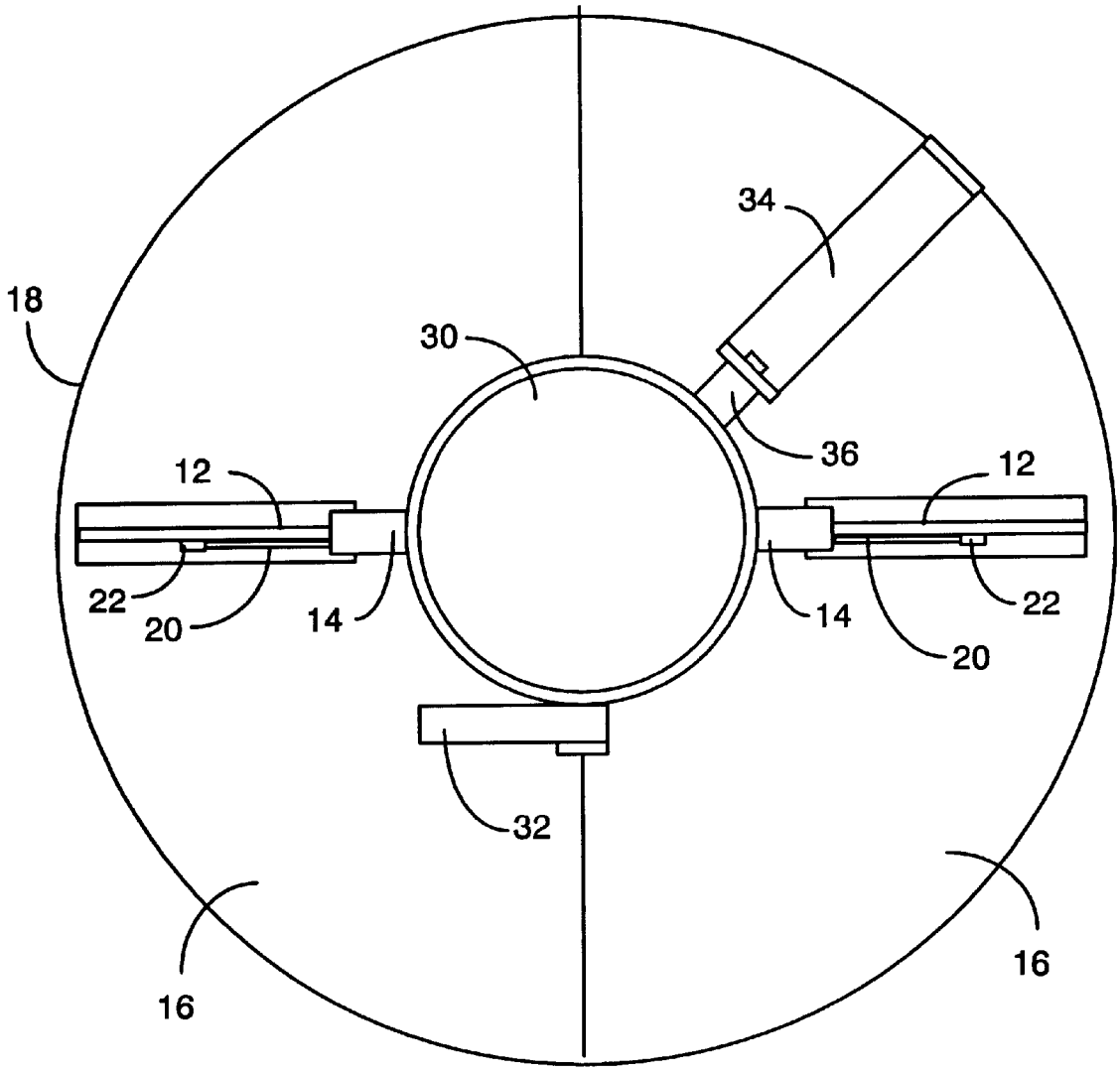
FIG. 3 is a top plan view of the preferred embodiment of FIG. 1 showing the damper assembly with the blades in a closed position.

In FIG. 3, a top plan view is shown that illustrates the preferred embodiment of FIG. 1 with the blades 16 in the closed position. For ease of illustration, blades stiffeners 12 are shown aligned with actuator bracket 14. However, though skilled in the art will recognize that actuator bracket 14 does not have to be aligned with blades stiffeners 12. While only one blade stiffener 12 is shown attached to each damper blade 16, the number of blade stiffeners 12 can vary.

The damper 10 can also be automatically reset to the open position shown in FIG. 1, once temperatures have declined to an acceptable level. In the case of a damper 10 which is actuated by pneumatic pressure, an air input line controlled by the reset circuitry would be used to restore the pneumatic pressure.

Figure 4:
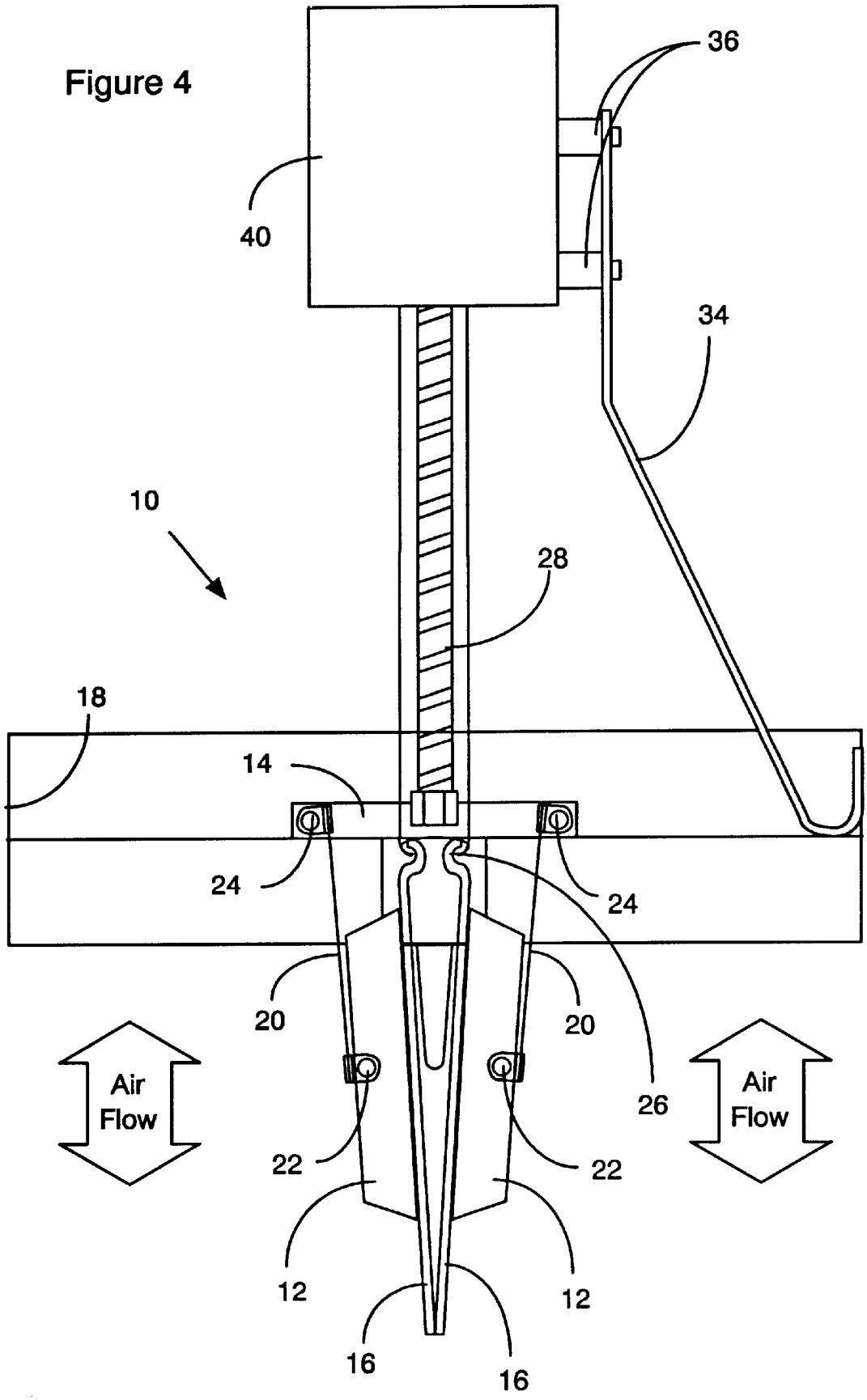
FIG. 4 is a cutaway side view of an alternative preferred embodiment that shows a damper assembly with the blades in an open position and with an electric motor powered actuator.

In FIG. 4, a side cutaway view of an alternative preferred embodiment is shown. In this embodiment, the powered actuator uses electric motor 40 in place of the pneumatic actuator 30. Electric motor 40 is preferably a stepper motor which allows more precise position control of the damper blades 16.

When stepper motor 40 is activated, it rotates threaded shaft 28 which in turn moves angled bracket 14 which then moves damper blades 16 from an open to a closed position, or vice versa. In addition, the stepper motor 40 may be used to partially open or close the damper blades 16. This is an advantage over the pneumatic actuator in that when the damper 10 is partially opened or closed under precision control of the stepper motor 40, the air flow through the damper can modulated. In large buildings, a central computer can use remote sensors to regulate air flow throughout the building by independently controlling each damper 10.

Stepper motor 40 may be attached to the damper frame. 18 by any suitable means, such as in the same manner that the pneumatic actuator 30 of the previous embodiment was attached to damper frame 18.

With respect to FIG. 4, it should be noted that there are different options with regard to the lead screw nut.

One option is to just fasten it to the brace 14. Another option is to have it be in two pieces, i.e., split so that it can be released by spring pressure. In other words, the two pieces can come apart, allowing a spring to close the damper.

The third option is to retain the outside of the nut and again have a release mechanism which gets rid of the retention mechanism so that the nut can fly up or spin. The release can be either a bi-metal or a solenoid device.

Figure 5:
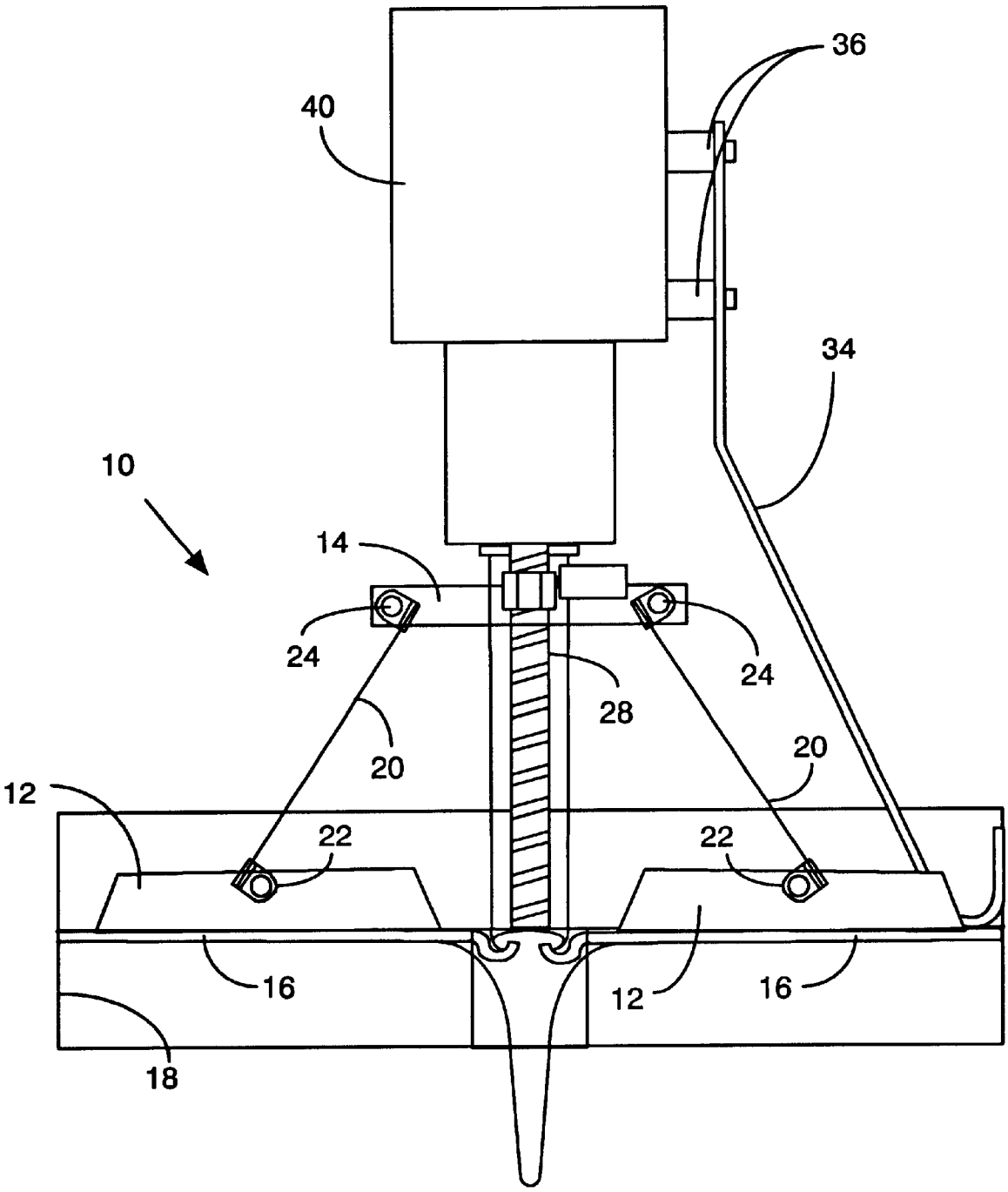
FIG. 5 is a cutaway side view of the preferred embodiment of FIG. 4 that shows the damper assembly with the blades in a closed position.

FIG. 5 is a cutaway side view of the preferred embodiment of FIG. 4 shown with the damper blades 16 in the closed position. The stepper motor 40 has rotated threaded shaft 28 which in turn has raised angled bracket 14. When angle bracket 14 is raised, members 20, which are connected to angle bracket 14 at pivot points 24 and interconnected to damper blades 16 at pivot points 22, pull damper blades 16 upward into the closed position.

In this electrically controlled version of my invention, the shaft 28 rides with a lead screw nut in the bracket 14. The shaft may engage limit switches for full open and full closed to turn the motor off. Here, the override is by a heat sensitive switch with a nine volt battery on each side. When the heat actuates, it opens the circuit, thereby reversing polarity and signaling the apparatus to close the damper. The electric lead screw actuator damper must be driven back in order to close it. The travel control switches stop travel and arm the reverse D.C. current.

Note in FIG. 5 a bearing is positioned at the end of the lead screw because the lead screw is the same size and stays there constantly and just turns. The nut rides up and down on the lead screw. If the nut is welded to the brace, then the device is useful for modulating.

The lead spring, as shown in FIG. 5, is used to force the blades closed. However, for modulating, such a screw is unnecessary. It is only useful when you use one of the other options for mounting the nut, so that the damper can be either in an opened or closed position. Also note that the opened position might be open only to a certain degree.

The angle of the threads on the lead screw must be such that the nut will not ride on its own because of associated pressure. Rather, the angle must be such as to be precise in positioning the nut.

In the case of power failure, it is desirable to have the nut released from the lead screw. This can be accomplished, for example, by a solenoid attached to one-half of the nut. When the power comes on, the solenoid retracts that half so that the nut is in disengagement from the lead screw. Thus, there are three distinct conditions: (1) when the power is always on and the solenoid is always engaged and the damper is powered to a closed position, or opened for a modulated position; (2) when you want to have the damper close automatically, such as by the spring. In that condition, the solenoid removes the half nut whether the motor is actually running or not at that moment; (3) to simply have the solenoid impinge upon the outside of the nut to keep it from turning. In the preferred embodiment, the angle of the threads is steeper, so the nut can turn more freely and indeed it is even preferable to have the nut mounted on the bearing for that purpose.

Figure 6:
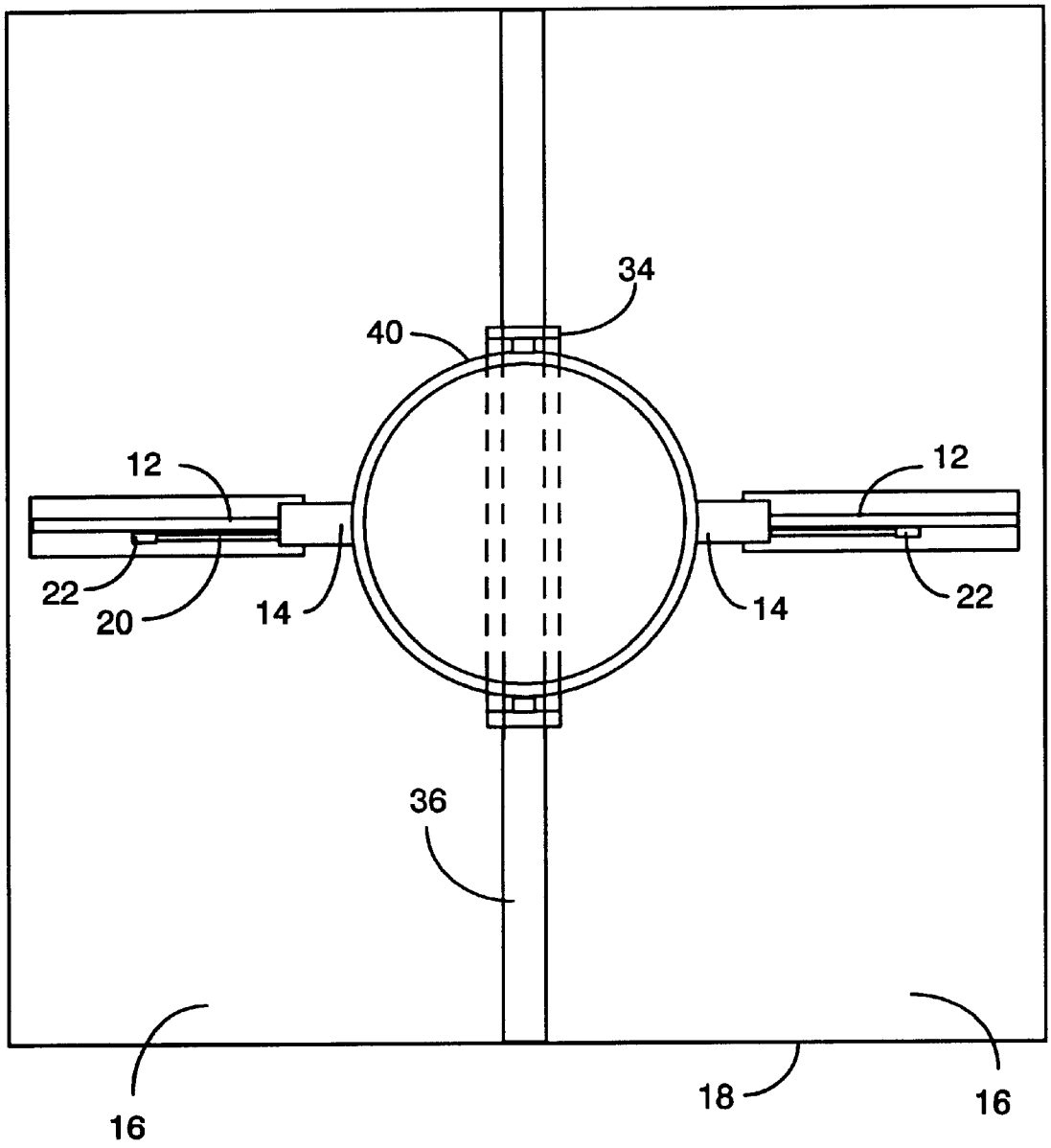
FIG. 6 is a top plan view of the preferred embodiment of FIG. 4 showing the damper assembly with the blades in a closed position.

FIG. 6 is a top plan view of the preferred embodiment of FIG. 4. Only two damper blades 16 are shown, and each damper blade 16 has only a single blade stiffener 12. The damper blades 16 may vary in size. As a practical matter, commercially available dampers typically have damper blade 16 sizes which vary from 16 to 24 inches.

Figure 7A:
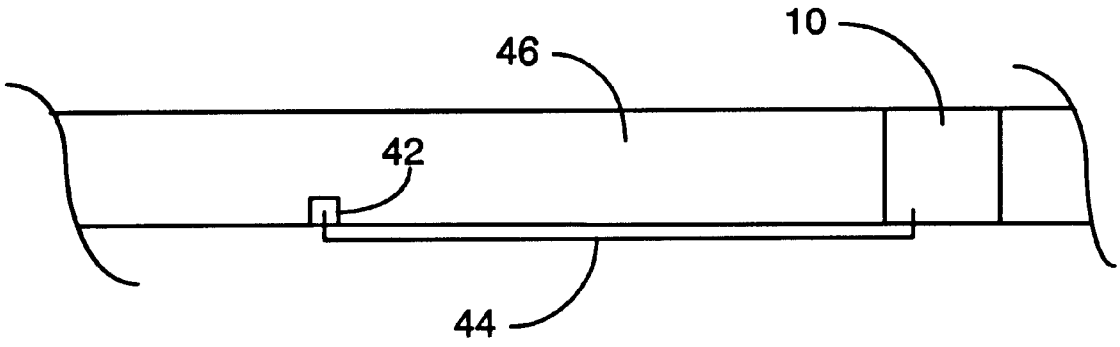
FIG. 7A illustrates an alternative preferred embodiment in which a remote sensor in an air duct controls a powered damper via hard wired lines.
Figure 7B:
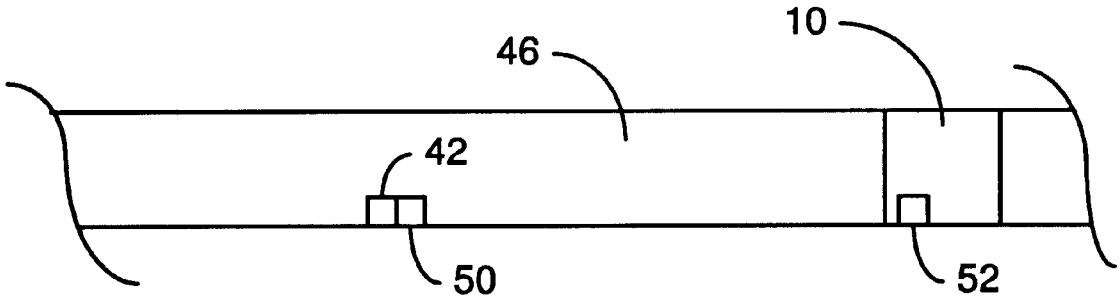
FIG. 7B illustrates another alternative preferred embodiment in which a remote sensor in an air duct controls a powered damper via radio communication.

FIGS. 7A and 7B illustrate other preferred embodiments of the invention which remotely control operation of the powered damper 10. In FIG. 7A, a remote sensor 42 is attached to damper 10 via hard wiring 44. When remote sensor 42 detects heat or smoke, it signals the power actuator 30 or 40 in damper 10 via wires 44. Damper 10 then closes to prevent smoke or fire from passing through damper 10. By locating sensor 42 at a distance from damper 10, damper 10 can close well in advance of the arrival of the smoke or the fire. The sensors can be in or out of the air duct.

FIGS. 7A and 7B show fire in the duct, but it should be noted that the wire might be outside the duct. FIG. 7A also shows an electric heat-actuated switch to control the motor relative to a smoke control system.

FIG. 7B illustrates another preferred embodiment of the invention. In this embodiment, the remote sensor 42 includes a radio transmitter 50. When the sensor 42 detects smoke or fire, it signals a receiver 52 which is attached to the damper 10. The receiver 52 notifies power actuator 30 or 40 (depending on the embodiment) which, in turn, closes the damper 10. Those skilled in the art will recognize that while the term radio is used, any suitable wireless communications technology may be used to implement this function. This embodiment eliminates the signal wire 44. This can be important because, depending on the location of a fire, the wiring may be damaged by fire before the remote sensor 42 detects the smoke or fire.

All the previous embodiments discussed control of the dampers 10 by powered actuators 30 or 40 for use in fire control situations. However, there are other reasons to control closure of dampers 10. For example, in manufacturing environments workers may be exposed to toxic fumes from a wide variety of sources. Specialized sensors of any type may be used in the manner described previously to protect workers or occupants of buildings from dangerous fumes which may have nothing to do with fire. In the case of toxic fumes, early detectio[008e] of the fumes, along with rapid and secure closure of the dampers 10, can be extremely important in terms of safety.

In addition, all of the dampers 10 in a given location may be controlled by a central computerized system (not shown) that may use a variety of sensor types including fire, smoke, toxic fumes, vibration (e.g. for use in earthquake prone areas), etc. In addition to centrally controlling the dampers 10 in emergency situations, a central computer can also be used to control damper 10 operation for the purpose of regulating ventilation in a building during normal use. The embodiment which uses a stepper motor 40 is particularly useful for this activity since it allows for precision control of the position of the damper blades 16.

FIGS. 7A–B illustrate the damper 10 installed in a horizontally oriented duct 46. However, the damper 10 can just as easily be installed in a vertically oriented duct 46, or one that is oriented in a variety of directions. This provides an advantage over gravity powered or spring powered dampers in that the orientation of the damper does not affect its performance.

Figure 8:
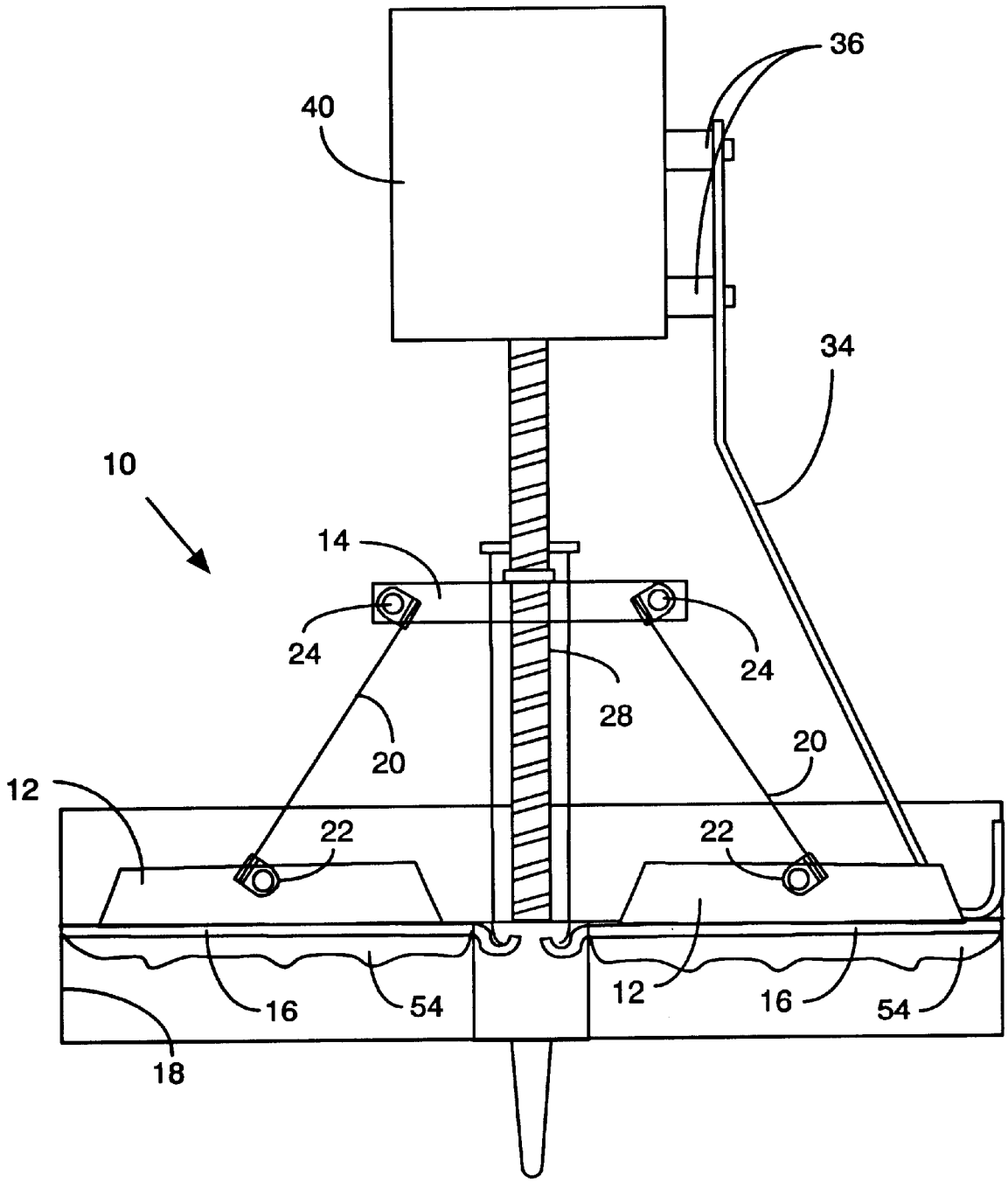
FIG. 8 illustrates another alternative preferred embodiment in which an optional radiation blanket is installed on the surface of the damper blades.

In FIG. 8, an optional radiation blanket 55 is illustrated. The radiation blanket 55 is attached to the surface of the damper blades 16. The radiation blanket 55 insulates the damper blades 16 from heat and helps to prevent deformity of the damper blades 16. The radiation blanket 55 can be fabricated from any suitable material which is resistant to the high temperatures found in a fire condition. This works best when the metal blades are exposed to the heat, rather than the insulation 55.

Figure 9A:
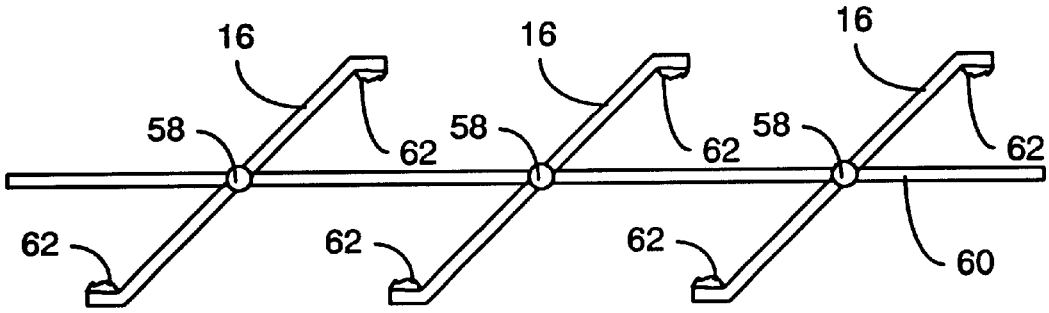
FIG. 9 illustrates an alternative preferred embodiment in which travel limit switches are placed on the actuator to automatically control the actuator at preset damper travel limits.
Figure 9B:
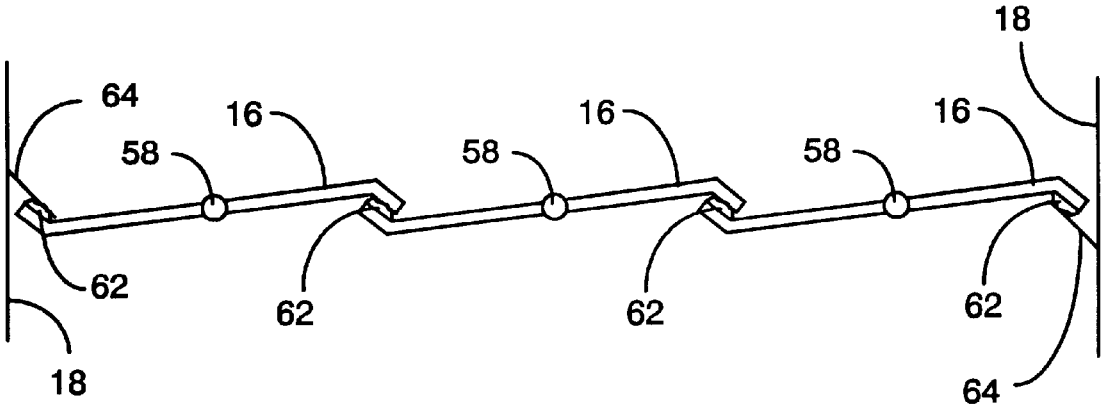

FIG. 9 is a side view that illustrates an alternative preferred embodiment in which the travel limit switches 66 are used to prevent the actuator 40 from attempting to move the damper blades 16 beyond preset damper blade travel limits. They may be hard wired as at 75, 76. Travel limit switches 66 prevent damage to the damper blades 16 which may have otherwise occurred if the w actuator 40 erroneously attempted to force the damper blades 16 beyond their intended travel limits. The travel limit switches 66 are electrically connected to the actuator 40 controls in the preferred embodiment. They may be enclosed, as shown, with the motor in a motor frame 67. However, those skilled in the art will recognize that a variety of methods can be used to implement this switching system. The motor may be twelve volt D.C.

Figure 10:
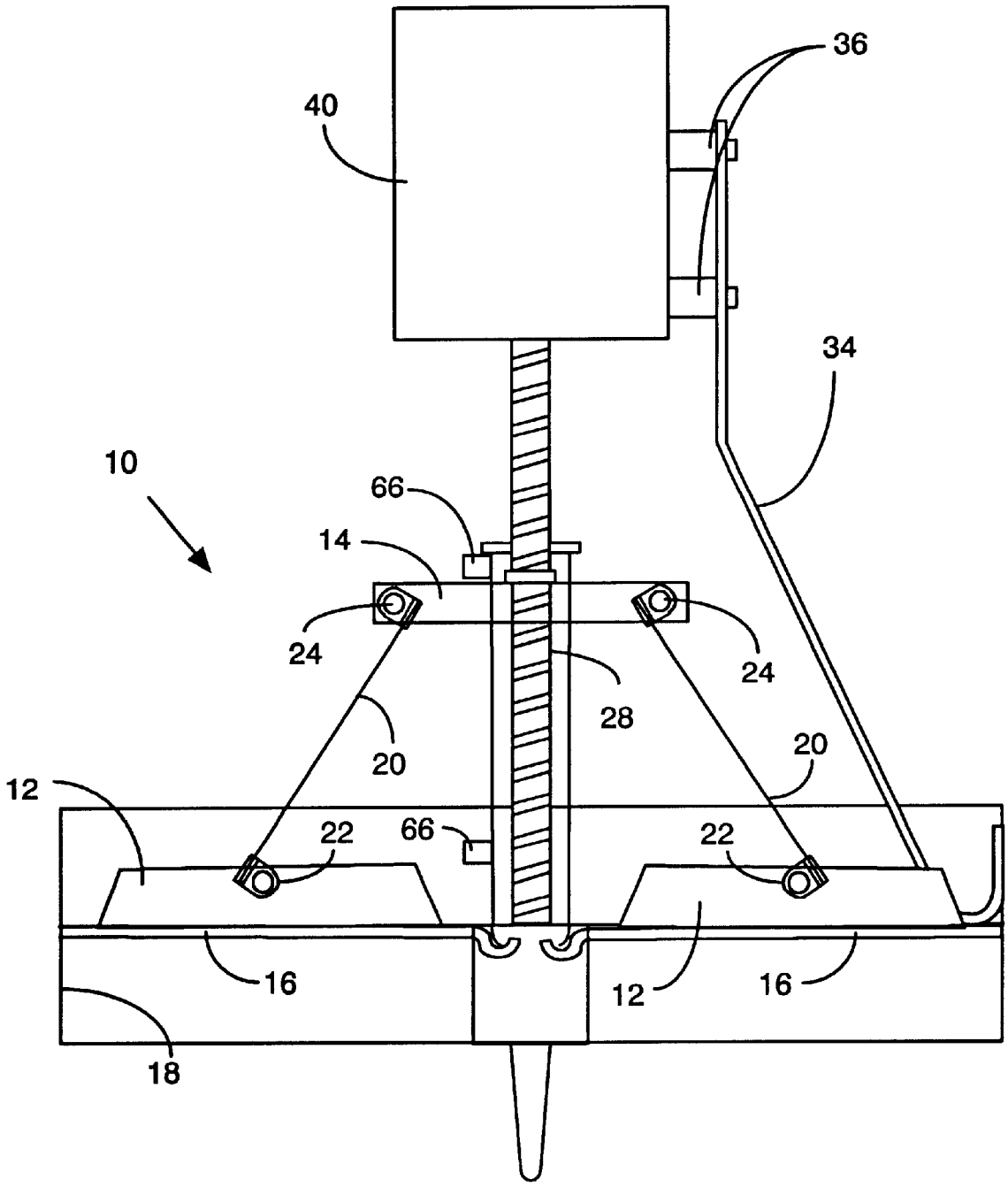
FIG. 10 illustrates another preferred embodiment in which a thermal locking mechanism is used to prevent the damper blades from being open in high temperature conditions.
Figure 11:
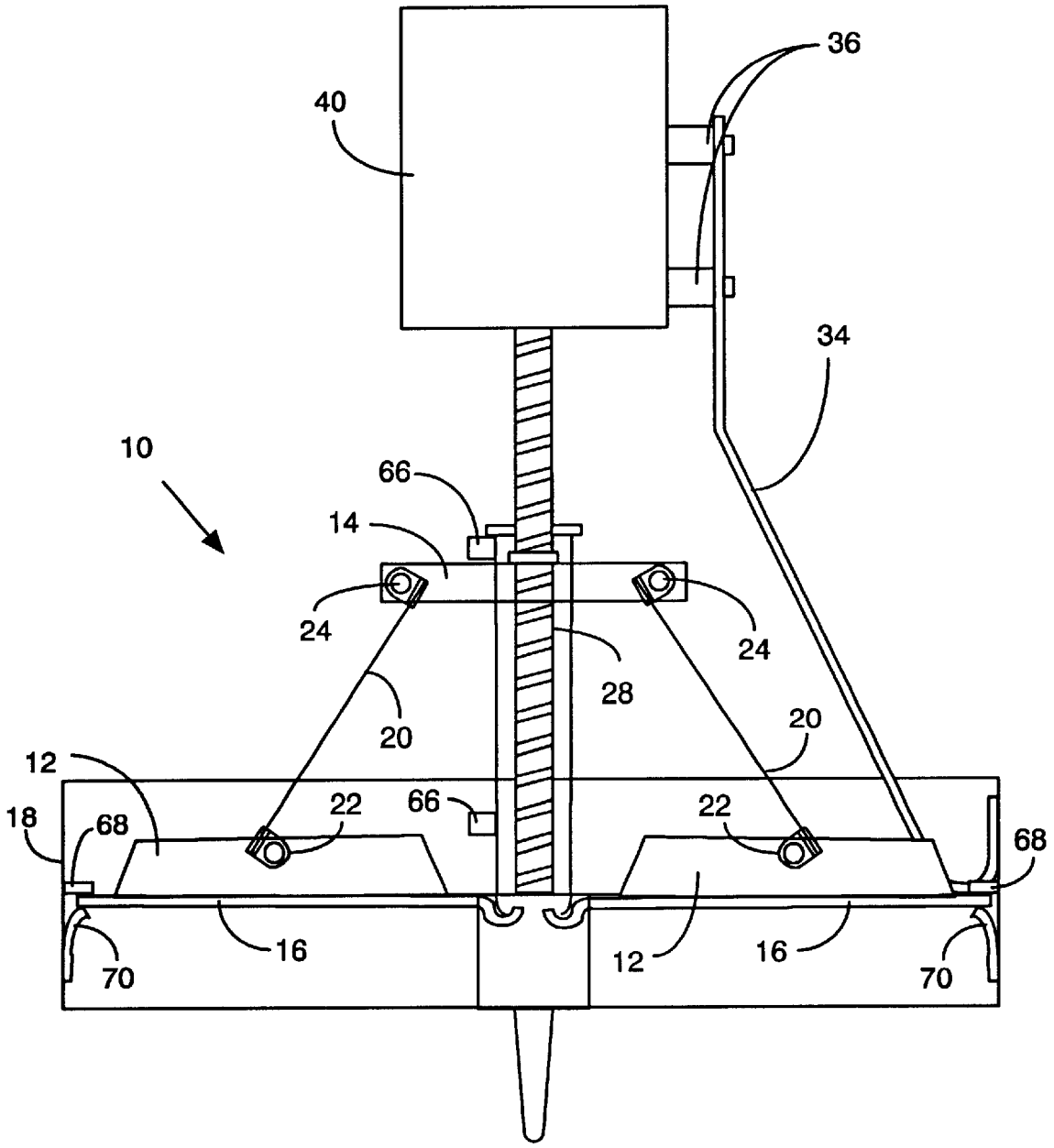

FIG. 10 illustrates another alternative embodiment in which a thermal locking mechanism is used to prevent the damper 10 from opening in high temperature conditions. Damper blades 16 are shown pressed against damper blade stops 68. The damper blades 16 are locked in the closed position by a thermal lock 70. In the preferred embodiment, thermal lock 70 is fabricated from a bi-metallic strip that is attached to damper frame 18. In low temperatures, thermal lock 70 rests flat against the wall of damper frame 18. In that situation, damper blades 16 are free to open and close without interference from thermal lock 70. However, in high temperature conditions the damper blades 16 will be closed by actuator 40 and press against damper blade stops 68. As the temperature increases, thermal lock 70 bends due to the different expansion rates in metals used to form the bi-metallic strip 70. Once heated, the bi-metallic strip extends outward from the damper frame into the travel path of damper blades 16 and prevents them from moving back to the open position. An advantage using thermal lock 70 is that it provides an extra measure of protection by ensuring that the damper 10 cannot open in high temperature conditions.

From what has been described, it will be appreciated that I have provided a novel butterfly powered damper which can be round, oval or rectangular in configuration; has a two direction lead screw or actuating shaft that holds the damper in open, closed or intermediate positions; is responsive to close or open positions by a thermal switch; is easily adjustable to set power and stroke for various size dampers; and is computer driven compatible.

From what I have disclosed, it will be appreciated by those skilled in the art that, in accordance with my invention, there are at least four dampers described: electric and pneumatic butterfly, electric multi-blade and another electric butterfly which is a diffuser mounted type (for room temperature and air volume control). In particular, it would be simpler to install a linear motorized (multi-blade or butterfly) modulating exhaust damper for pressure control, while the diffuser mounted damper more readily controls temperature and volume. The use of the smoke/fire safety dampers is a novel heating, ventilating and air conditioning methodology which also would add pressurization and eliminate the current practice that is supposed to control room temperature (but does not in reality know what the room conditions are). In other words, the safety products would do all the heating, ventilating and air conditioning functions and replace the current means of doing them. The systems can be pressure, temperature, volume and smoke or any combination of these. The pressure systems can be normal building pressure differential for the control of the environment and fire and smoke emergency systems. There can also be the stairwell or escape route pressurization. Also, there are pressurization sub-systems such as in operating rooms where the contaminants are kept out, or unfriendly environments where the contaminants are kept in.

While the invention has been described with respect to a preferred embodiments thereof, it will be understood by those skilled in the art that various changes in detail may be made without departing from the spirit, scope, and teaching of the invention. For example, the material used to fabricate the damper may be anything suitable for the intended use in conditions of potential fire, smoke, or toxic fumes. The size and shape of the damper may also vary. The number of blades may vary in size, shape or orientation.

What I claim is:

1. A powered damper assembly mounted within a duct, comprising:

a butterfly damper, further comprising:

a damper frame; and damper blades pivotally attached to the damper frame such that the damper has an open position to allow air flow therethrough and a closed position to prevent air flow through the damper frame;

a powered actuator cycling means attached to the damper, comprising a pneumatic actuator having a shaft means axially movable within the duct toward and away from the blades in response to pneumatic pressure changes;

a source of pneumatic pressure connected to the pneumatic actuator;

means to change the level of pneumatic pressure; and opposing pressure means set in opposition to the pneumatic pressure source and providing opposing pressure such that a change in the level of pneumatic pressure in relation to the opposing pressure means will result in axial movement of the movable shaft means; and said shaft means, attached at one end to the pneumatic actuator and attached at its other end to the damper blades, such that the powered actuator cycling means can move the shaft means axially and cause the damper blade to move and cycle between an open position and a closed position by varying the pneumatic pressure.

2. A powered damper assembly, as in claim 1, further comprising: a first blade travel switch attached to the movable shaft such that it notifies the powered actuator when the movable shaft has moved the damper blades to the open position; and a second blade travel switch attached to the movable shaft such that it notifies the powered actuator when the movable shaft has moved the damper blades to the closed position.

3. A powered damper assembly, as in claim 1, further comprising a thermal lock, the thermal lock attached to the damper assembly such that it does not restrict movement of the damper blades in normal operating conditions, and further attached to the damper assembly such that in high temperature conditions caused by fire, the thermal lock prevents the damper blades from moving from the closed to the open position.

4. A method of controlling air flow through a damper mounted in a duct by opening and closing a butterfly damper having blades and a frame, by means of a powered damper actuator, comprising the steps of:

pivotally attaching the damper blades to the damper frame such that the damper has an open position to allow air flow therethrough and a closed position to prevent air flow therethrough;

attaching, within the duct, a powered actuator means having a pneumatic assembly to the damper frame and blades for moving the blades;

attaching, within the duct, a movable shaft means at one end to the pneumatic assembly and at its other end to the damper blades such that upon activation by the pneumatic assembly, the movable shaft means is moved axially within the duct and moves the damper blades from an open position to a closed position;

whereby the damper is closed by the powered actuator.

5. A method, as in claim 4, including the additional step of connecting a sensor to the powered actuator, the sensor having means to control activation of the powered actuator to control opening or closing of the damper when a sensed condition indicates that the damper should be opened or closed;

whereby the sensor controls air flow through the damper.

6. A method, as in claim 5, including the additional step of connecting a sensor to the powered actuator, the sensor having means to control activation of the powered actuator to control the position of the blades of the damper between opening or closing of the damper when a sensed condition indicates that the damper should be partially opened or closed;

whereby the sensor controls air flow through the damper.

7. A method, as in claim 6, including the additional step of locating the sensor remotely from the damper;

whereby the sensor can activate the damper before the sensed condition triggering activation of the powered actuator reaches the damper.

8. The damper assembly of claim 1 wherein, the pneumatic assembly comprises, a bellows-type valve having a bladder, and a means to bleed-off the air in the bladder; and a spring in the actuator engaging a means to close the damper when the air is bled from the bladder.

9. The damper assembly of claim 8 wherein the means to bleed off the air is a heat responsive means.

10. The method of claim 4 wherein the additional steps of providing a bellows-type valve having a bladder and a means to bleed off the air in the bladder, as part of the pneumatic assembly; and providing a spring in the actuator engaging a means to close the damper such that when air is bled from the bladder, the damper closes under the action of the spring.

* * * * *

UNITED STATES PATENT AND TRADEMARK OFFICE

CERTIFICATE OF CORRECTION

PATENT NO. : 6,447,393 B1
DATED : September 10, 2002
INVENTOR(S) : Francis J. McCabe It is certified that error appears in the above-identified patent and that said Letters Patent is hereby corrected as shown below:

Title page,
Item [54], the title has been changed to:
-- PNEUMATIC POWER ACTUATED BUTTERFLY BLADE DAMPER AND METHOD OF CONTROLLING AIR FLOW --

Signed and Sealed this

Fourteenth Day of October, 2003

JAMES E. ROGAN
*Director of the United States Patent and Trademark Office*